US006309173B1

(12) United States Patent
Marx

(10) Patent No.: US 6,309,173 B1
(45) Date of Patent: Oct. 30, 2001

(54) DELIVERY PUMP

(75) Inventor: Peter Marx, Kassel (DE)

(73) Assignee: Mannesmann VDO AG (DE)

( * ) Notice: Subject to any disclaimer, the term of this patent is extended or adjusted under 35 U.S.C. 154(b) by 0 days.

(21) Appl. No.: 09/486,935

(22) PCT Filed: Oct. 2, 1998

(86) PCT No.: PCT/EP98/06291

§ 371 Date: Jun. 19, 2000

§ 102(e) Date: Jun. 19, 2000

(87) PCT Pub. No.: WO99/18356

PCT Pub. Date: Apr. 15, 1999

(30) Foreign Application Priority Data

Oct. 6, 1997 (DE) ..... 197 44 037

(51) Int. Cl.[7] ..... F04D 29/42
(52) U.S. Cl. ..... 415/55.1; 415/169.1
(58) Field of Search ..... 415/55.1, 55.2, 415/55.3, 55.4, 55.5, 203, 169.1; 123/516

(56) References Cited

U.S. PATENT DOCUMENTS 6,152,687 * 11/2000 Wilhelm et al. ..... 415/55.1
6,152,688 * 11/2000 Staab et al. ..... 415/55.5

* cited by examiner

*Primary Examiner*—Edward K. Look
*Assistant Examiner*—James M. McAleenan
(74) *Attorney, Agent, or Firm*—Richard A. Speer; Mayer, Brown & Platt

(57) ABSTRACT

A feed pump (2) designed for feeding fuel in a motor vehicle, with an impeller (7) having vane chambers (10, 10*a*, 11, 11*a*) delimited by guide vanes (12, 13), and in casing parts (3, 4) adjacent to the impeller (7) and having part-annular channels (14, 15) arranged in the region of the vane chambers (10, 10*a*, 11, 11*a*), has a degassing duct (19), the start of which is arranged downstream of an inlet port (8). Some of the vane chambers (10) are connected to the degassing duct (19) via pockets (20) worked into the impeller (7). By means of this degassing duct (19), gas bubbles present in the fuel are discharged reliably from the feed pump (2).

9 Claims, 2 Drawing Sheets

DELIVERY PUMP

Figure 1:
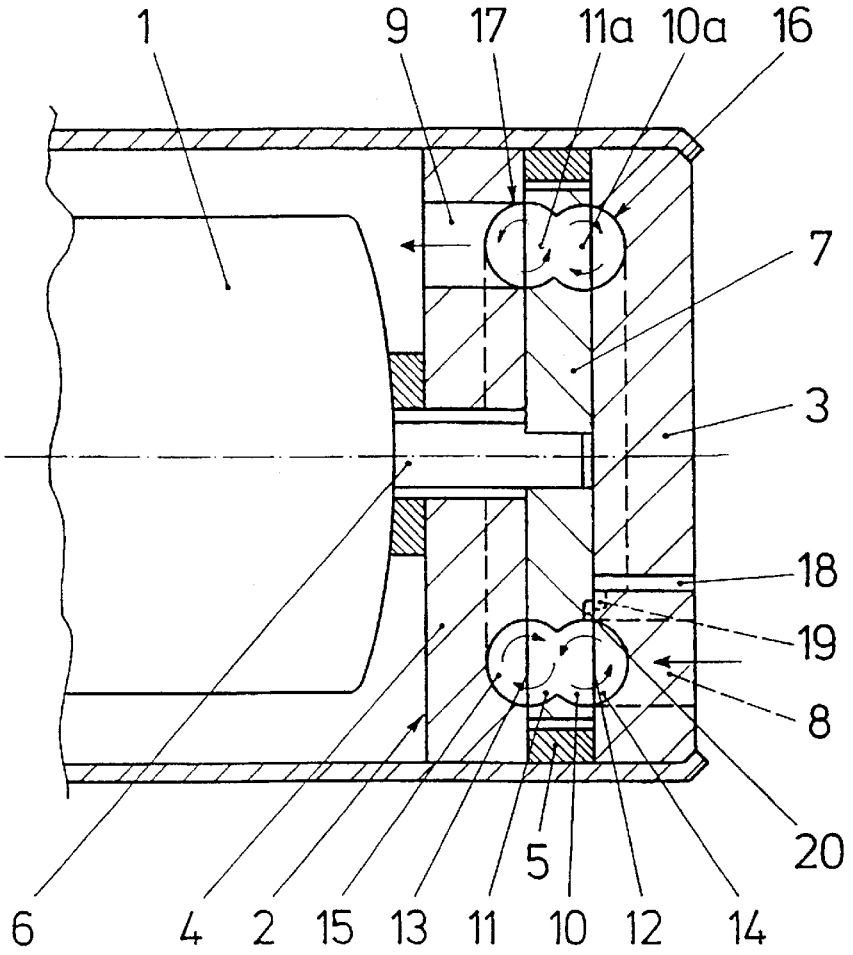

The invention relates to a feed pump with a driven impeller which rotates in a pump casing and in which a ring of guide vanes delimiting vane chambers is arranged in at least one of its end faces, and with a part-annular channel which is arranged in the pump casing in the region of the guide vanes and forms with the vane chambers a feed chamber for feeding a liquid from an inlet port to an outlet port and which has a degassing duct arranged in a radially inner region of the pump casing, as seen from the part-annular channel, and having a degassing bore leading out of the feed pump.

Such feed pumps are known as peripheral or side channel pumps and are used, for example, for feeding fuel or for feeding washing fluid to a window cleaning system of a motor vehicle. In this case, the guide vanes generate, in the feed chamber, a circulating flow running transversely to the direction of movement of the guide vanes. The degassing duct serves for discharging gas bubbles, present in the liquid to be fed, through the degassing bore out of the feed pump. When fuel is fed by means of the feed pump, this is important, for example during a hot start of the motor vehicle, since, in this case, the temperature of the fuel is particularly high and dust bubbles therefore often occur due to evaporation of the fuel. Furthermore, when the feed pump is first filled, air bubbles present in the feed chamber may be discharged through the degassing bore. Such air bubbles often lead to foaming of the liquid in the feed chamber and therefore likewise to reduced delivery of the feed pump.

In a feed pump known from practice, the degassing duct is located directly upstream of the outlet port, as seen in the direction of rotation of the impeller, and is connected to the feed chamber via a gap which is small in comparison with the diameter of the part-annular channel. The gas bubbles pass through the gap into the degassing duct.

The problem on which the invention is based is to design a feed pump of the type initially mentioned, in such a way that gas bubbles present in the liquid to be fed are discharged as completely as possible.

This problem in solved, according to the invention, in that only some of the vane chambers have a connection to the degassing duct.

In a feed pump, in which feed chambers are arranged on both sides of the impeller and have a connection for the overflow of the liquid from one feed chamber into the other feed chamber, the inlet port opening into one of the feed chambers and the outlet port into the other feed chamber, and the degassing duct being arranged in a feed pump casing part having the inlet port, only some of the vane chambers having a connection to the degassing duct, a line for the gas bubbles from the outlet-side region of the feed pump, said line being complicated to lay in place, is avoided.

By virtue of this design, as a result of a rotation of the impeller the gas bubbles are first forced into a radially inner region of the feed chamber by virtue of their density which is low in comparison with the liquid to be fed. The gas bubbles are subsequently removed from the feed chamber at a particularly early time. As a result, the gas bubbles are separated from the liquid virtually completely, before they are entrained by the circulating flow. Cavitation in the part-annular channel is therefore kept particularly low.

In principle, as in the known feed pump, the feed chamber could be connected to the degassing duct via a gap. However, such a gap causes turbulence in the circulating flow of the liquid. This turbulence leads to a reduction in the efficiency of the feed pump. Furthermore, turbulence in the circulating flow leads to regions of high pressure and regions of low pressure. In the regions of low pressure, the liquid may evaporate at high temperatures and therefore generate gas bubbles. This turbulence is kept particularly low according to the solution for achieving the object.

According to another advantageous development of the invention, efficiency losses brought about by connecting the vane chambers to the degassing duct are kept particularly low if the proportion of vane chambers connected to the degassing duct is 10 to 50% of the total number of vane chambers.

According to another advantageous development of the invention, a contribution is made to a further reduction in the turbulence caused by the connection of the vane chambers to the degassing duct if the connections of the vane chambers to the degassing duct are formed by pockets worked into the impeller.

According to another advantageous development of the invention, the impeller can be produced particularly cost-effectively if the connections of the vane chambers to the degassing duct are formed by a radial widening of the vane chambers which points in the direction of the axis of rotation of the impeller.

Since a small quantity of the liquid to be fed is also discharged through the degassing duct, it is advantageous, in order to achieve as high a delivery of the feed pump as possible, to design the degassing duct so as to be particularly small. The feed pump according to the invention has a particularly high delivery if the cross section of the degassing duct is 2% to 12.5% of the cross section of the feed chamber.

According to another advantageous development of the invention, the gas bubbles are separated particularly reliably from the liquid to be fed if the degassing duct extends over an angular range of 30° to 180°.

A contribution to a further improvement in the efficiency of the feed pump according to the invention is made if the degassing duct extends over an angular range of 45° to 110°. By virtue of this design, a particularly small quantity of the liquid to be fed passes through the degassing orifice and therefore out of the feed pump.

To avoid the escape of fuel vapor, it is necessary for a counterpressure to oppose the pressure within the feed chamber. For this purpose, for example, a throttle could be arranged in the degassing bore. However, such a throttle obstructs a reliable discharge of the gas bubbles from the feed chamber. According to another advantageous development of the invention, the gas bubbles are discharged reliably from the degassing duct if the degassing bore has approximately the same diameter as the degassing duct. In this case, a pressure in the degassing duct counteracting the pressure in the feed chamber can be established by an appropriate design of the cross section of the degassing duct.

Figure 2:
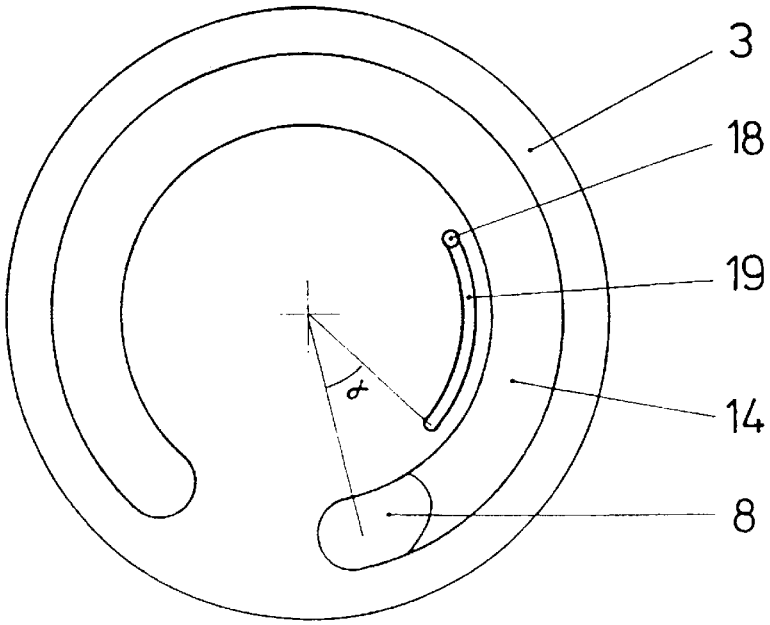
Figure 3:
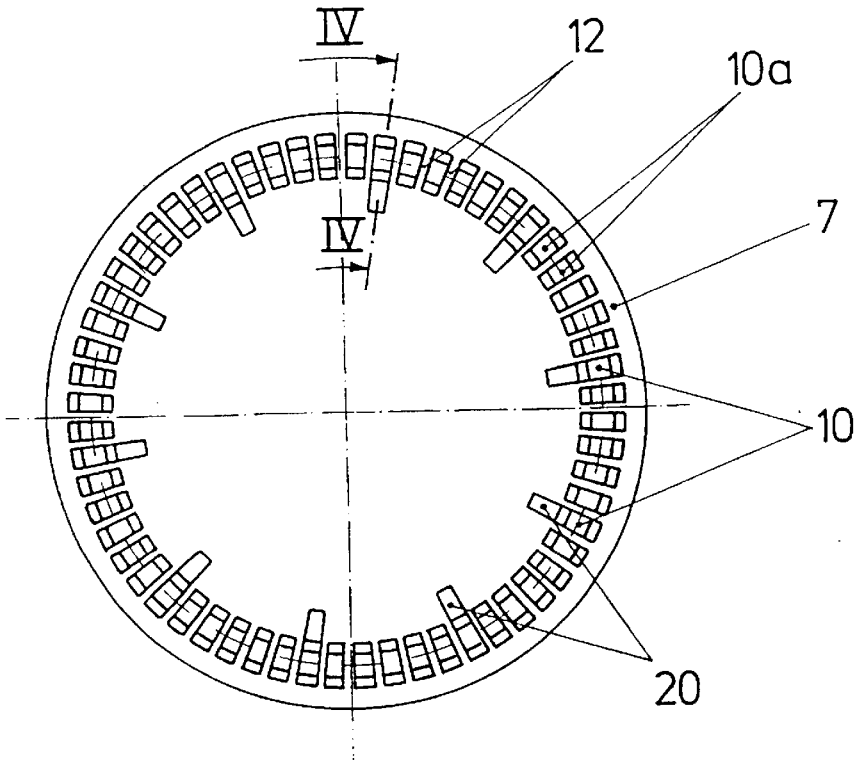
Figure 4:
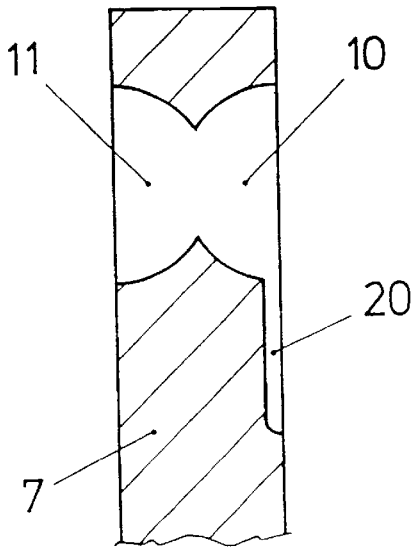
Figure 5:
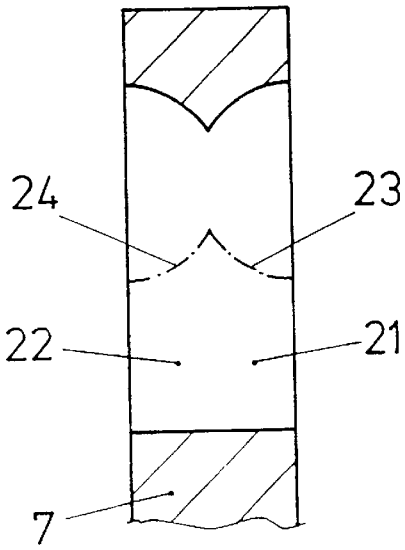

The invention permits numerous embodiments. In order to make its basic principle even clearer, two of these are illustrated in the drawing and are described below. In the drawing:

FIG. 1 shows a diagrammatic illustration of a feed pump according to the invention in a longitudinal section, FIG. 2 shows an inlet-side casing part of a pump casing from FIG. 1, FIG. 3 shows an impeller of the feed pump according to the invention from FIG. 1, as seen from the inlet-side casing part, FIG. 4 shows a part section through the impeller from FIG. 3 along the line IV—IV, FIG. 5 shows a part section through a further embodiment of the impeller.

FIG. 1 shows a feed pump 2 according to the invention, driven by an electric motor 1 and designed as a side channel pump, with an inlet-side casing part 3 and with an outlet-side casing part 4. The casing parts 3, 4 are prestressed against an annular spacer 5. An impeller 7 fastened on a shaft 6 of the electric motor 1 is arranged rotably between the casing parts 3, 4. When the impeller 7 rotates, a liquid to be fed is fed from an inlet port 8 arranged in the inlet-side casing part 3 to an outlet port 9 worked into the outlet-side casing part 4.

A ring of guide vanes 12, 13 delimiting vane chambers 10, 10*a*, 11, 11*a* is worked into each of the two end faces of the impeller 7. Vane chambers 10, 10*a*, 11, 11*a* in each case located opposite one another are connected to one another. The casing parts 3, 4 of the feed pump 2 each have a part-annular channel 14, 15 in the region of the vane chambers 10, 10*a*, 11, 11*a*. The part-annular channels 14, 15 form, together with the vane chambers 10, 10*a*, 11, 11*a*, feed chambers 16, 17. When the impeller 7 rotates, circulating flows of a liquid to be fed occur in the feed chambers 16, 17. For the sake of clarity, the circulating flows are identified by arrows. Through the connection of vane chambers 10, 10*a*, 11, 11*a* located opposite one another, the liquid to be fed can overflow virtually without turbulence from one feed chamber 16 into the other feed chamber 17.

A degassing duct 19 opening into a degassing bore 18 is arranged in the inlet-side casing part 3. Some of the vane chambers 10 are connected to the degassing duct 19 via pockets 20 worked into the impeller 7. As a result, gas bubbles composed, for example, of liquid in vapor form are led out of the feed chambers 16, 17. Such gas bubbles occur, in particular, when the feed pump 2 is used as a fuel pump in a fuel tank of a motor vehicle and the fuel has high temperatures.

FIG. 2 shows the inlet-side casing part 3 from FIG. 1, as seen from the impeller 7. The start of the degassing duct 19 is arranged approximately 15° downstream of the inlet port 8, as seen in the direction of rotation of the impeller 7, and extends over an angular range of 45°. Gas bubbles present in the liquid to be fed are reliably discharged through this degassing duct 19. However, an escape of the liquid to be fed and consequently a reduction in the efficiency of the feed pump 2 are kept particularly low.

FIG. 3 shows the impeller 7 from FIG. 1, as seen from the inlet-side casing part 3. Here, the individual vane chambers 10, 10*a*, which are separated from one another by the guide vanes 12, can be seen. The majority of the vane chambers 10*a* have the same dimensions as the part-annular channel 14. The remaining vane chambers 10 have the pockets 20 which are led into the region of the degassing duct 19 illustrated in FIGS. 1 and 2.

The contour of the vane chambers 10 having the pockets 20 is illustrated, greatly enlarged, in FIG. 4. The vane chambers 10 have an approximately circular cross section in the region of the part-annular channels 14, 15 illustrated in FIG. 1. The pockets 20 have a substantially smaller depth than the vane chambers 10, 11. As a result, gas bubbles present in the liquid to be fed can accumulate in the pockets 20, without being picked up by the circulating flow illustrated by arrows in FIG. 1. The gas bubbles are therefore discharged through the degassing duct 19, illustrated in FIG. 1, together with a particularly small quantity of liquid to be fed.

FIG. 5 shows a second embodiment of vane chambers 21, 22 connected to the degassing duct 19 illustrated in FIG. 1. Here, the vane chambers 21, 22 are enlarged in the direction of the axis of rotation of the impeller 7. For the sake of clarity, the contour of vane chambers 23, 24 not connected to the degassing duct is depicted by dashes and dots in the drawing.

What is claimed is:

1. A feed pump with a driven impeller which rotates in a pump casing and in which a ring of guide vanes delimiting vane chambers is arranged in at least one of its end faces, and with a part-annular channel which is arranged in the pump casing in the region of the guide vanes and forms with the vane chambers a feed chamber for feeding a liquid from an inlet port to an outlet port and which has a degassing duct arranged in a radially inner region of the pump casing, as seen from the part-annular channel, and having a degassing bore leading out of the feed pump, wherein only some of the vane chambers (10, 21) have a connection to the degassing duct (19).

2. A feed pump, as defined in claim 1, wherein feed chambers are arranged on both sides of the impeller, which have a connection for the overflow of the liquid from one feed chamber into the other feed chamber, the inlet port opening into one of the feed chambers and the outlet port into the other feed chamber, wherein the degassing duct (19) is arranged in one casing part (3) of the feed pump (2), said casing part having the inlet port (8), and wherein only some of the vane chambers (10, 21) have a connection to the degassing duct (19).

3. The feed pump as defined in claim 1 or claim 2, wherein the proportion of vane chambers (10, 21) connected to the degassing duct (19) is 10 to 50% of the total number of vane chambers (10, 10*a*, 21, 23).

4. The feed pump as defined in either claim 1 or claim 2, wherein the connections of the vane chambers (10) to the degassing duct (19) are formed by pockets (20) worked into the impeller (7).

5. The feed pump as defined in claim 3, wherein the connections of the vane chambers (21) to the degassing duct (19) are formed by a radial widening of the vane chambers (23) which points in the direction of the axis of rotation of the impeller (7).

6. The feed pump as defined in either claim 1 or claim 2, wherein the cross section of the degassing duct (19) is 2 to 12.5% of the cross section of the feed chamber (16, 17).

7. The feed pump as defined in claim 3, wherein the degassing duct (19), starting from the region of the inlet port (8), extends over an angular range of 30° to 180°.

8. The feed pump as claimed in claim 7, wherein the degassing duct (19) extends over an angular range of 45° to 110°.

9. The feed pump as defined in either claim 1 or claim 2, wherein the degassing bore (18) has approximately the same diameter as the degassing duct (19).

* * * * *